United States Patent [19]

Patterman

[11] 3,987,509

[45] Oct. 26, 1976

[54] SWIMMING TAIL

[75] Inventor: Samuel Patterman, Surfside, Fla.

[73] Assignee: Lawrence Peska Associates, Inc., New York, N.Y. ; a part interest

[22] Filed: Sept. 8, 1975

[21] Appl. No.: 611,547

[52] U.S. Cl. ..... 9/309

[51] Int. Cl.[2] ..... A63B 31/08

[58] Field of Search ..... 9/309, 310 D, 301, 302, 9/303, 304

[56] References Cited

UNITED STATES PATENTS

| | | | |
|---|---|---|---|
| 3,165,764 | 1/1965 | Christiansen | 9/309 |
| 3,315,286 | 4/1967 | Brion | 9/309 |
| 3,335,441 | 8/1967 | Wolfe | 9/309 |
| 3,609,782 | 10/1971 | Mabuchi | 9/310 D |

*Primary Examiner*—Trygve M. Blix
*Assistant Examiner*—Stuart M. Goldstein
*Attorney, Agent, or Firm*—Jack D. Slobod

[57] ABSTRACT

A swimming tail is formed by a pair of elongated flippers of substantially identical exterior shape adapted to be used in side by side relationship. Each flipper includes an elongated fin of teardrop cross-section which tapers to a point. Foot receiving openings within the two flippers are oriented in opposite directions relative to the exterior shape of the flippers.

1 Claim, 5 Drawing Figures

SWIMMING TAIL

FIELD OF THE INVENTION

The present invention relates generally to flippers and swimming tails which are adapted to be worn. In its particular aspects, the present invention relates to a set of flippers one of which has an elongated fin projecting from a heel end and the other of which has a similar elongated fin projecting from a toe end.

BACKGROUND OF THE INVENTION

Various swimming aids have heretofor been suggested which are utilized by moving the feet somewhat in unison in a manner bearing some relationship to the movement of the tail of the fish. Illustrative of the prior art in this regard are U.S. Pat. Nos. 3,082,442; 3,165,764; 3,335,441 and 3,344,449. These aforementioned swimming aids have not operated in an optimum fashion because they have not sufficiently approximated the operation of a fish's tail.

OBJECTS OF THE INVENTION

It is an object of the present invention to provide a swimming tail which is configured to create thrust in the nature of a fish's tail.

It is a further object of the present invention to provide a pair of flippers for use in side by side relationship which together form a composite tail including fin portions projecting from the front and back of the feet.

SUMMARY OF THE INVENTION

Briefly, the aforementioned and other objects of the present invention are satisfied by providing a pair of elongated flipper elements adapted to be worn on the feet of the user in side by side relationship. Each flipper has a foot receiving portion having a toe end and a heel end. An elongated fin of teardrop shaped cross-section projects from a toe end of one of the openings for forward extension of one foot and a similar fin projects from the heel end of the other opening for rearward extension of the other foot. Each of the fins has a longitudinally directed linear edge adapted to face the head of the user and each fin tapers from the width of the foot to a substantially pointed end.

By the provision of forward and rearward extension of the feet side to side movements of the two legs in unison create thrusts in the nature of those produced by a fish's tail.

Other objects, features and advantages of the present invention will become apparent upon perusal of the following detailed description of the preferred embodiment thereof when taken in conjunction with the appended drawing wherein.

DETAILED DESCRIPTION

Figure 1:
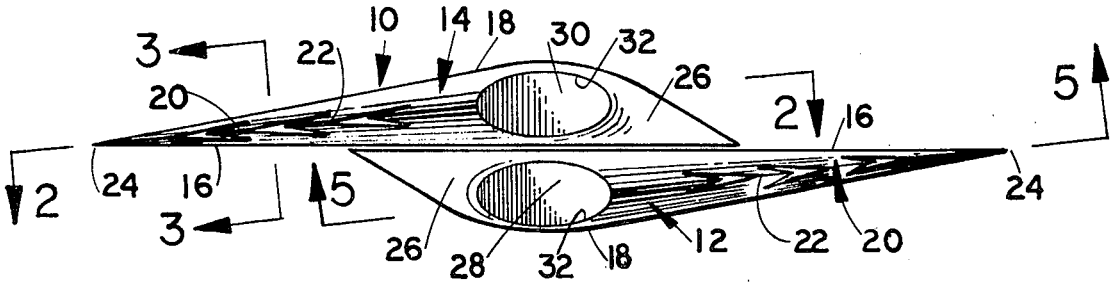
FIG. 1 is a top view of a pair of flippers according to the present invention.
Figure 2:
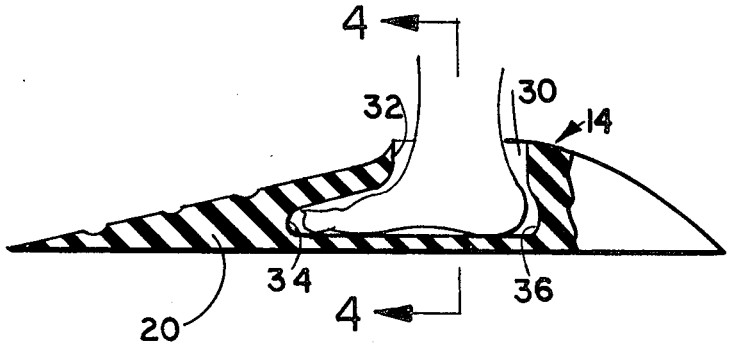
FIG. 2 is a longitudinal cross-sectional elevation of the right flipper along the lines 2—2 in FIG. 1.
Figure 3:
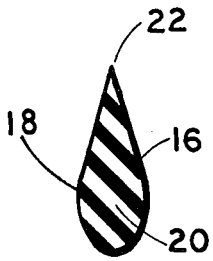
FIG. 3 is a transverse cross-sectional elevation of the right flipper along the lines 3—3 in FIG. 1.
Figure 4:
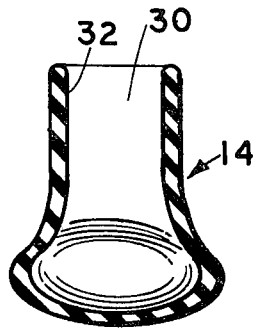
FIG. 4 is a transverse cross-sectional elevation of the right flipper along the lines 4—4 in FIG. 2.
Figure 5:
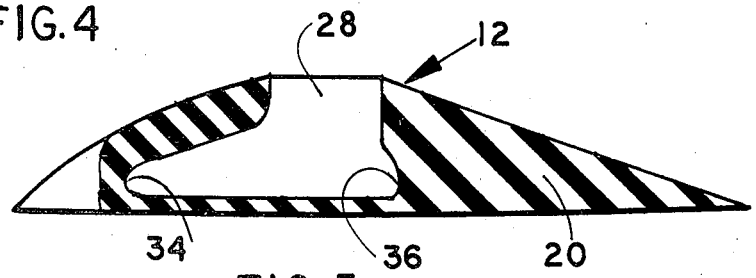
FIG. 5 is a longitudinal cross-sectional elevation of the left flipper along the lines 5—5 in FIG. 1.

Referring to FIGS. 1 through 5 of the drawing there is shown a swimming tail 10 formed by a pair of elongated left and right rubber flippers 12 and 14 which are adapted to be worn on the feet of a user in opposite facing directions.

When viewed from the top, as in FIG. 1, the flippers 12 and 14 are preferably of substantially identical exterior shape. Each has a generally straight side 16 along which the two flippers abut in side by side relationship in use. Opposite side 16 is an arcuate side 18 which tapers back to side 16 at opposite ends of each flipper.

Defined between sides 16 and 18 on each of the flippers 12 and 14 is an elongated longitudinally directed fin 20 of teardrop shaped cross-section. The fins 20 have an upwardly projecting longitudinally directed sharp linear edge 22 which may be described as being adapted to face the head of the user when the flippers 12 and 14 are worn. Further, the fins 20 linearly taper in width to a substantially pointed end 24.

On each of the flippers 12 and 14 in a direction substantially opposite the projecting fin 20 there is a projection 26 of considerably shorter length.

Openings 28 and 30 are formed respectively in flippers 12 and 14 each having an oval mouth 32 for insertion of the foot. The portion of each opening 28 and 30 within the flippers 12 and 14 have a toe end 34 and a heel end 36.

As should now be apparent from the drawing, in the flipper 14 fin 20 projects from toe end 39 in forward extension of the right foot which in flipper 12, fin 20 projects from heel end 36 in rearward extension of the left foot.

In the use of the swimming tail 10 of the present invention the flippers are placed together along the sides 16 and the feet and legs are moved in unison in a side to side motion for exerting symmetrical side thrusts with the sides 16 and 18 of fins 20 projecting in both forward and rearward extension of the feet.

The tapered teardrop cross-section provides a hydrodynamic foil shape which is both effective for the aforementioned side thrust action as well as exerting thrusts when the feet are separately kicked in the manner in which conventional flippers are used.

While the preferred embodiment of the present invention has been described and illustrated in specific detail it should be noted that numerous modifications, additions and omissions in the details thereof are possible within the intended spirit and scope of the invention claimed herein.

What is claimed is:

1. A composite swimming tail apparatus comprising: a pair of separate elongated flippers adapted to be worn on the feet of a user and to be operated with the feet maintained in side by side relationship; said flippers having generally straight side surfaces facing each other for enabling said flippers to abut each other at said side surfaces to form said composite swimming tail; each of said flippers having a foot receiving opening having a heel end and a toe end; a first elongated fin projecting rearward from the heel end of the foot receiving opening of one of said flippers; a second elongated fin projecting frontward from the toe end of the foot receiving opening of the other of said flippers; each of said first and second fins being of teardrop-shaped transverse cross-section oriented to define a longitudinally directed upwardly facing linear edge; said cross-section tapering in width along the length of each of said fins from the foot receiving opening of each flipper to a substantially pointed end.

* * * * *